United States Patent [19]

Dellar

[11] 4,070,547

[45] Jan. 24, 1978

[54] ONE-POINT STEREO MICROPHONE

[75] Inventor: Fred Jay Dellar, Sun Valley, Calif.

[73] Assignee: Superscope, Inc., Chatsworth, Calif.

[21] Appl. No.: 647,337

[22] Filed: Jan. 8, 1976

[51] Int. Cl.[2] ..... H04R 5/00

[52] U.S. Cl. ..... 179/1 G; 179/1 DM

[58] Field of Search ..... 179/1 DM, 1 G, 121 R, 179/121 D, 139

[56] References Cited

U.S. PATENT DOCUMENTS 3,027,423 3/1962 Reinthaler ..... 179/1 DM

FOREIGN PATENT DOCUMENTS 214,496 4/1961 Austria ..... 179/1 DM 260,315 6/1966 Austria ..... 179/1 DM

*Primary Examiner*—Douglas W. Olms

*Attorney, Agent, or Firm*—Fulwider, Patton, Rieber, Lee & Utecht

[57] ABSTRACT

A stereo microphone having two transducer elements that are mechanically held together, adjacent each other, with one of the elements acting as an electrical transducer for audio signals reaching it from the right, and the other element acting as a similar transducer to convert audio signals reaching it from the left.

2 Claims, 5 Drawing Figures

ONE-POINT STEREO MICROPHONE

BACKGROUND OF THE INVENTION

In the stereophonic broadcasting and recording of sound, it is necessary to have the sound from the left side separately recorded and reproduced from the sound from the right side. This is often accomplished with spaced microphones, but it is often difficult for the amateur or the hobbiest to position and maintain microphones in spaced relationship when he wishes to make a stereo recording. It is often possible to secure a comparable result if two microphones, both directional, are placed back to back so that each microphone receives sound coming from a different direction. Preferably, the microphones should be separable from each other, so that, when desired, the microphones can be separated and spaced apart so that they may record in the normal stereophonic manner.

SUMMARY OF THE INVENTION

The present invention comprises a microphone assembly making use of a pair of microphones that are mechanically, but releasably held together. Each of the microphones has similar acoustic and electrical characteristics and each has directivity characteristics such that it responds to sound coming to it from only one side. One form of microphone having such a directivity characteristic is often referred to as a cardioid microphone. The means holding the two microphones together may be of any suitable type, such as a simple mortise and tenon or dove-tail slide.

DESCRIPTION OF THE INVENTION

To make a stereophonic recording, it is generally considered necessary to make two separate recordings, or channels, one corresponding to sounds from the right hand side, and the other corresponding to sounds from the left hand side. Often, the two separate channels are provided by two separate microphones, spaced from each other and connected to separate recording channels. The stereophonic effect can be enhanced or diminished by the placement of the microphones, and while amateurs become quite proficient in securing good stereophonic results, the placement of the microphones is always a problem and in many instances, there is no real opportunity to make the necessary effort to secure the optimum results.

In many instances, the person making the recorder has no opportunity to separately locate two microphones spaced apart a predetermined distance and located in a particular spot. While stereophonic results may be desired, the person doing the recording in many instances is restricted to a single location and must do all of his recording at that location, or not do it at all.

Figure 1:
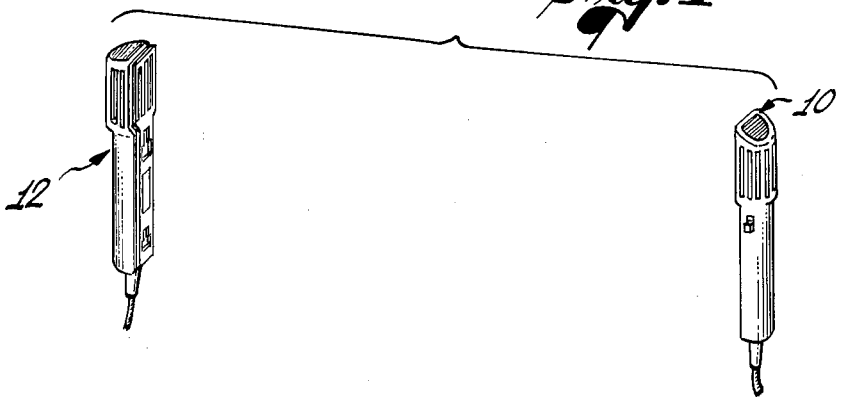
FIG. 1 is perspective view of the two elements of the stereo microphone, separated from each other as they might be in normal stereophonic recording.
Figure 2:
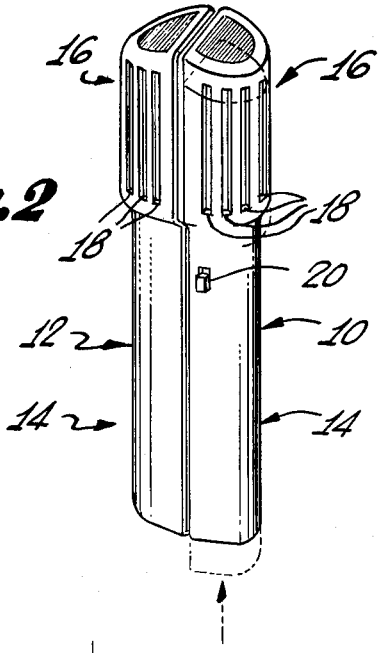
FIG. 2 is a perspective view of the two elements in their combined position.

The present invention contemplates the use of microphones that are adaptable to either spaced point stereophonic recordings or one-point stereophonic recordings. Thus, in FIG. 1, two microphones 10 and 12, corresponding to the right and left channels, respectively, are shown, these microphones being spaced from each other so that they will record the sounds coming from the right and from the left, respectively. This, of course, is the customary manner of making stereophonic recordings. It is often impossible or impractical to make use of such a spaced relationship of the microphones 10 and 12, yet a stereophonic recording is desired. Under these conditions, the microphones 10 and 12 may be combined, as indicated in FIG. 2, to create a one-point stereo microphone.

Figure 5:
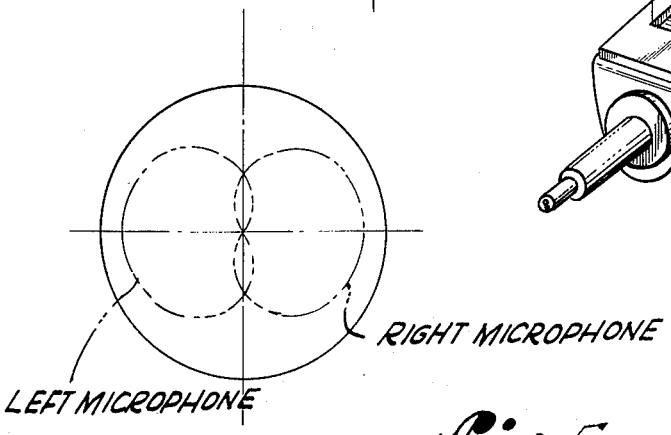
FIG. 5 is a diagram indicating the directivity characteristics of the complete microphone combination.

As indicated in that figure, microphones 10 and 12 are mechanically held together to provide a single unit with the microphone 10 still responding only to the sound from the right, and microphone 12 responding only to sound from the left. To achieve this separation, the directivity characteristics of the two microphones 10 and 12 must be substantially uni-directional so that each microphone responds only to sound coming to it from the appropriate direction. The directivity characteristics of the combined microphones are illustrated in FIG. 5, where the response of the microphones is plotted in polar coordinates in the conventional fashion. While the response of each of these microphones as usually referred to a cardioid, it is not essential that the microphones have this characteristic so long as they are essentially uni-directional.

It will be appreciated that the positioning of right and left microphones 10 and 12 immediately adjacent each other, back-to-back, will have the effect of reducing the response of each of the microphones to sounds coming from the unwanted or back direction. Each of the microphones will, of course, pick up a certain amount of sound coming to it from its side, but its principal response will be to sound coming to it from its front.

Figure 3:
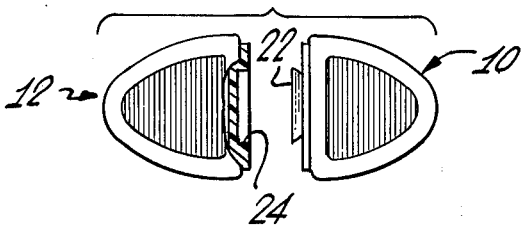
FIG. 3 is a top plan view with the two elements separated a slight distance from each other showing the tenon on one of the elements and with the other element partially broken away to show the mortise into which the tenon slides.
Figure 4:
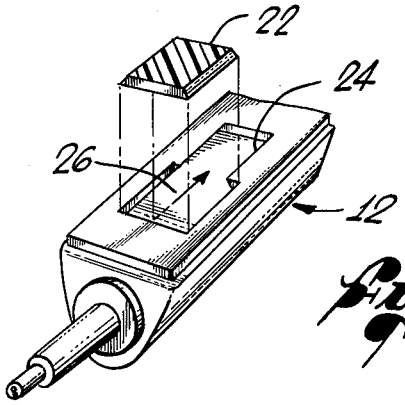
FIG. 4 is a perspective view of a portion of the connecting means, the mortise being clearly shown and the tenon and its movement into and along the mortise being clearly indicated.

One method of releaseably connecting microphones 10 and 12 together is illustrated in FIGS. 3 and 4. It will be recognized that each of the microphones 10 and 12 has a housing of suitable material such as a plastic, including a handle portion 14, and a pierced section portion 16 having apertures 18 through which the sound passes to the actual sound-responsive elements of the microphone. The handle portion 14 may contain various components associated with the microphone, such as an amplifier, a power supply and other elements, as needed. The components included within the handle 14 will, of course, be governed by the particular type of sound transducer located within the pierced section 16. A manually operated switch 20 is preferably provided in one of the microphones, such as the right microphone 10, so that the operation of the recording system may easily be controlled.

As indicated in FIG. 3, a tenon 22 is formed on the back of one of the microphone 10 while a cooperating mortise 24 is formed in the back of the other microphone 12. At one end of the mortise 24, the overhanging edges of the mortise are cut away to provide an aligned recess 26 into which the tenon 22 may be placed for insertion into the mortise 24. This construction is clearly indicated in FIG. 4. Thus, to connect the right and left microphones 10 and 12 together to form a one-point stereo microphone, the tenon 22 of right microphone 10 is placed in the recess 26 of left microphone 12 and the microphones then slid with respect to each other so that the tenon 22 moves into and is held by the mortise 24. This movement is indicated in FIG. 2 where the dotted outline of right microphone 10 indicates its relative position with respect to left microphone 12 when the tenon 22 is in the recess 26. The solid outline of microphone 10 indicates the reelative positions of microphones 10 and 12 when 10 and 22 are held by mortise 24.

It will be realised that other forms of holding means may be used without departing from the concept of the this invention. While the holding means shown is convenient and effective, many other releaseable means are known and are very satisfactory for this use.

With the right and left microphones 10 and 12 mechanically connected together as indicated in FIG. 2, stereophonic recording may be accomplished with the microphones located at a single point. This method of operation is particularly useful when recording is done without an opportunity to separate the microphones, and stereo recording is desired. It may be advantageously performed in recording music, in recording conferences or in recording topical events, such as gathering news material.

While a preferred form of the invention has been disclosed, it is to be understood that it is not to be limited to the particular form or arrangement of parts herein described and shown, escept as limited by the claims.

I claim:

1. A one-point stereo microphone which includes:

a first uni-directional microphone adapted to respond to sounds from a hemisphere;

a second uni-directional microphone adapted to respond to sounds from a hemisphere, each of said first and second microphones being capable of and intended for independent normal operation;

a housing for each of said first and second microphones, each of said housings being generally elongated with a flat side along the elongated direction and each of said microphones responding to sound from the hemisphere opposite said flat side; and releasable means located on said flat sides of said housings and including a mortise and tenon connection whereby said microphones may be connected together with their flat sides abutting and with said microphones held against rotation with respect to each other.

2. A one-point stereo microphone as described in claim 1 in which said housings and said releasable means co-operate to insure that said microphones are both at the same end of said housings when said housings are connected together.

* * * * *